US007506458B2

(12) United States Patent
Lee et al.

(10) Patent No.: US 7,506,458 B2
(45) **Date of Patent: *Mar. 24, 2009**

(54) DRYING MACHINE

(75) Inventors: Soon Jo Lee, Changwon-si (KR); Hwan Joo Myung, Suwon-si (KR)

(73) Assignee: LG Electronics Inc., Seoul (KR)

( * ) Notice: Subject to any disclaimer, the term of this patent is extended or adjusted under 35 U.S.C. 154(b) by 14 days.

This patent is subject to a terminal disclaimer.

(21) Appl. No.: 11/393,670

(22) Filed: Mar. 31, 2006

(65) Prior Publication Data

US 2006/0218976 A1 Oct. 5, 2006

(30) Foreign Application Priority Data

Mar. 31, 2005 (KR) ..... 10-2005-0026934

(51) Int. Cl.
*F26B 11/02* (2006.01)

(52) U.S. Cl. ..... 34/601; 34/606

(58) Field of Classification Search ..... 34/595, 34/601, 606

See application file for complete search history.

(56) References Cited

U.S. PATENT DOCUMENTS

| | | | | |
|---|---|---|---|---|
| 4,231,166 | A * | 11/1980 | McMillan | 34/553 |
| 4,385,452 | A * | 5/1983 | Deschaaf et al. | 34/562 |
| 4,525,937 | A * | 7/1985 | Strandberg et al. | 34/550 |
| 5,172,490 | A * | 12/1992 | Tatsumi et al. | 34/488 |
| 5,940,986 | A * | 8/1999 | Jelinek et al. | 34/528 |
| 6,141,887 | A * | 11/2000 | Chen et al. | 34/475 |
| 6,775,923 | B2 * | 8/2004 | Do | 34/527 |
| 6,941,678 | B2 * | 9/2005 | Park | 34/528 |
| 2002/0042965 | A1 * | 4/2002 | Salem et al. | 15/339 |

FOREIGN PATENT DOCUMENTS

| | | |
|---|---|---|
| DE | 602 10 577 T2 | 8/2006 |
| EP | 1 508 636 | 2/2005 |
| EP | 1 518 957 | 3/2005 |

OTHER PUBLICATIONS

German Office Action dated Jan. 24, 2008.

* cited by examiner

*Primary Examiner*—S. Gravini
(74) *Attorney, Agent, or Firm*—Ked & Associates, LLP

(57) ABSTRACT

A drying machine having a drum mounted within a cabinet on a base unit is provided. The base unit includes a base lower unit, and a base upper unit positioned atop the base lower unit to define passages therebetween. The base unit includes a moisture sensor mounting portion that receives a moisture sensor on a top of the base upper unit. The moisture sensor senses a moisture level of air flowing through the passages.

28 Claims, 8 Drawing Sheets

DRYING MACHINE

BACKGROUND OF THE INVENTION

1. Field of the Invention

The present invention relates to a drying machine, and more particularly, to a drying machine with a moisture sensor for sensing the level of moisture in vapor passing through the drum of the drying machine.

2. Description of the Related Art

Modern washing machines are able to automatically perform an entire washing course, where a one-time setting of controls sets automated wash, rinse, and spin cycles.

Additionally, washing machines, with an added function for drying laundry that has been washed, are now being manufactured, which can also be used as a dedicated dryer to dry laundry that has already been washed.

A drum dryer is a home appliance that dries laundry by circulating hot, dry air within a drying drum to dry laundry inserted therein.

In detail, drum dryers are divided into condenser dryers that circulate air between the drying drum and a heater to dry laundry inside the drum, and vented dryers that direct from the outside into the dryer, whereupon it is heated by a heater and directed into the drying drum to dry laundry, after which the air is exhausted from the drying drum to the outside.

In a vented dryer, indoor air flows into the dryer, past the heater and the drum, and through a lint filter which removes it of lint. The air that passes through the lint filter then flows through an exhaust assembly formed at the bottom of the dryer, to be exhausted to the outside.

The air that is heated by the heater to become hot, dry air enters the drying drum and absorbs moisture from laundry therein. The air that has absorbed the moisture within the laundry drum is exhausted from the drum in the state of hot, moist vapor.

Here, the drying cycle is continuously performed until the moisture level of the vapor leaving the drying drum falls below a preset value, whereupon the drying cycle is completed. Therefore, it is necessary to install a sensor that can measure the moisture level of vapor passing through the drying drum at a predetermined interval.

SUMMARY OF THE INVENTION

Accordingly, the present invention is directed to a drying machine that substantially obviates one or more problems due to limitations and disadvantages of the related art.

An object of the present invention is to provide a drying machine with an installed moisture sensor that can accurately measure the moisture level of vapor passing through the drum.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a drying machine including: a base lower unit forming a passage within; a base upper unit mounted on a top of the base lower unit for covering the passage; a moisture sensor mounting portion formed on a top of the base upper unit; and a moisture sensor mounted on the moisture sensor mounting portion, for sensing a moisture level of air flowing through the passage.

In another aspect of the present invention, there is provided a drying machine of the type having a drum within for drying laundry, the drying machine including: a base forming a passage for water vapor exiting the drum; a moisture sensor formed on a side of the passage, for measuring a moisture level of the water vapor; and a microcomputer for reading the moisture level of the water vapor measured by the moisture sensor and determining whether to stop a drying cycle based on the reading.

In yet another aspect of the present invention, there is provided a drying machine including: a drum; a base forming a passage for air exiting the drum, the passage including a main passage intersecting with a sub passage; and a moisture sensor formed on an upper portion of the main passage or the sub passage, for measuring a moisture level of the air.

The above drying machine can quickly stop a drying cycle by accurately measuring the change in moisture level in air that changes to a hot, moist state as it passes through the drum.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
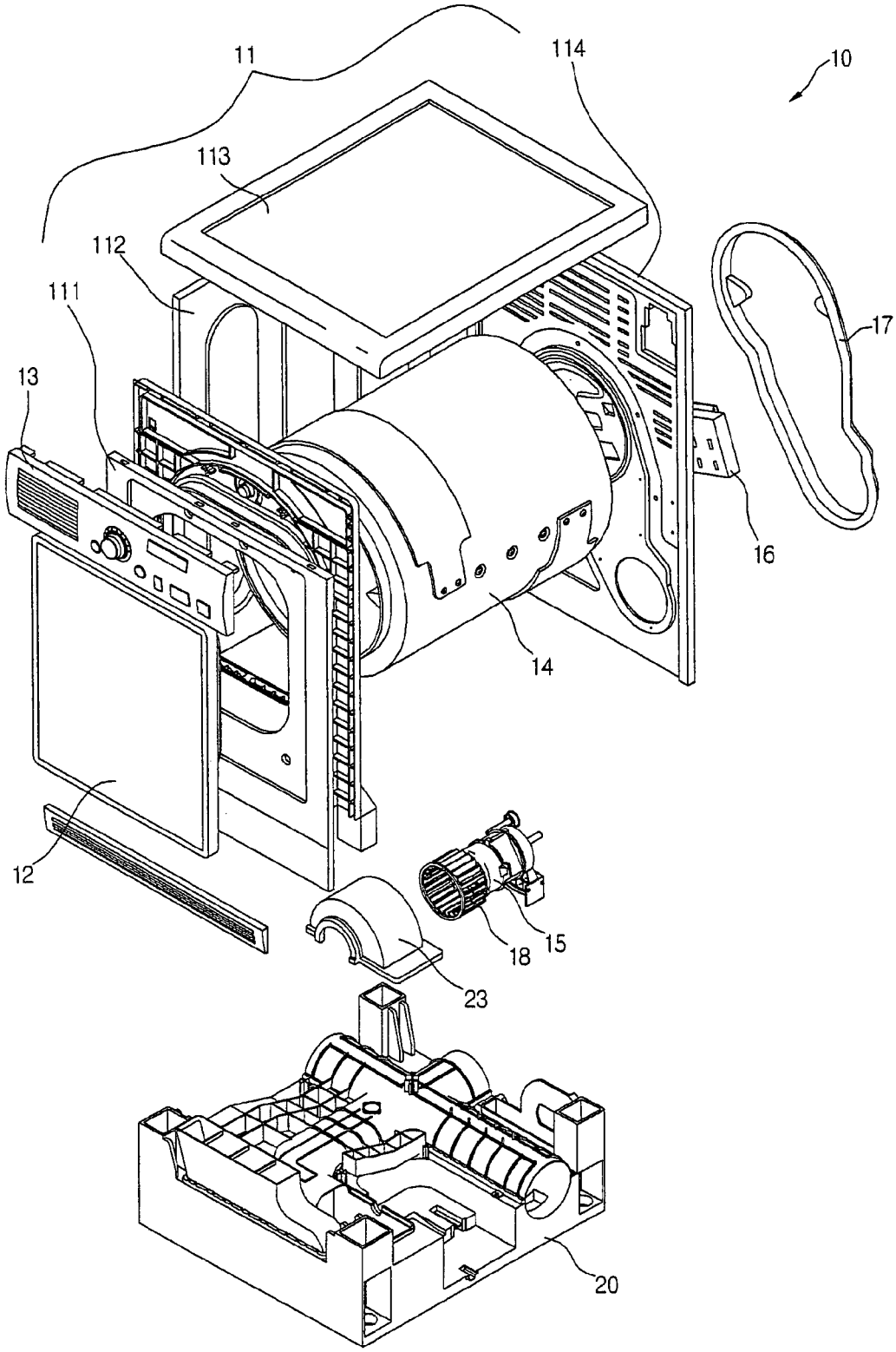
FIG. 1 is an exploded perspective view of a drying machine according to the present invention.

FIG. 1 is an exploded perspective view of a drying machine according to the present invention.

Referring to FIG. 1, a drying machine 10 according to the present invention includes a drum 14 for putting laundry into, a cabinet 11 installed outside the drum 14 for protecting the drum 14, a base 20 installed below the drum 14 and having an air exhaust duct formed within, and a motor 15 mounted on the upper portion of the base 20 for rotating the drum 14.

Also included are, a blower 18 connected to the drive shaft of the motor 15 for suctioning indoor air, and a blower cover 23 for protecting the blower 18.

In more detail, the cabinet 11 includes a front cover 111 for supporting the front portion of the drum 14, a side cover 112 installed on the side of the drum 14, a top cover 113 provided at a top of the drum 14, and a back cover 114 supporting the rear of the drum 14.

The drying machine 10 also includes a door 12 pivotally installed at the front of the front cover 111 to open and close the opening at the front of the drum 14 for inserting and extracting laundry, a control panel 13 installed above the door 12 and having buttons for inputting washing/drying settings and operation, a drying duct 17 installed at the rear of the back cover 114 to guide outside air into the drying drum, and a heater 16 installed inside the drying duct 17 to heat the outside air drawn in.

The operation of the above-described drying machine 10 will now be explained.

First, a user opens the door 12 and inserts laundry into the drum 14. Then, using the setting portion on the control panel 13, the user inputs washing/drying settings. When the start button is pressed, the motor 15 and the heater 16 installed inside the drying duct 17 operate. A suctioning blower installed below the base 20 rotates to suction outside air into the drying machine 10.

In more detail, outside air enters the drying duct 17 through an outside air intake port (described later) formed at the bottom of the back cover 114, and is heated while passing through the drying duct 17. The heated air enters the drum 14 through a rear wall of the drum 14. The heated air that enters the drum 14 absorbs moisture imbued in laundry and becomes water vapor. The air that becomes hot and moist leaves the drum 14 by passing through a lint filter (not shown) formed on the front cover 111, shedding impurities such as lint in the process.

The air that passes through the lint filter flows along the exhaust passage (described below) installed on the base 20, and is ultimately exhausted out from the drying machine 10. Here, the base 20 forms a passage within for air to be exhausted, and exhaust ports are formed on the sides and rear of the base 20. One of the exhaust ports may be open while the remaining ports may be sealed. The air passage formed within the base 20 will be described in further detail below with reference to the diagrams.

Figure 2:
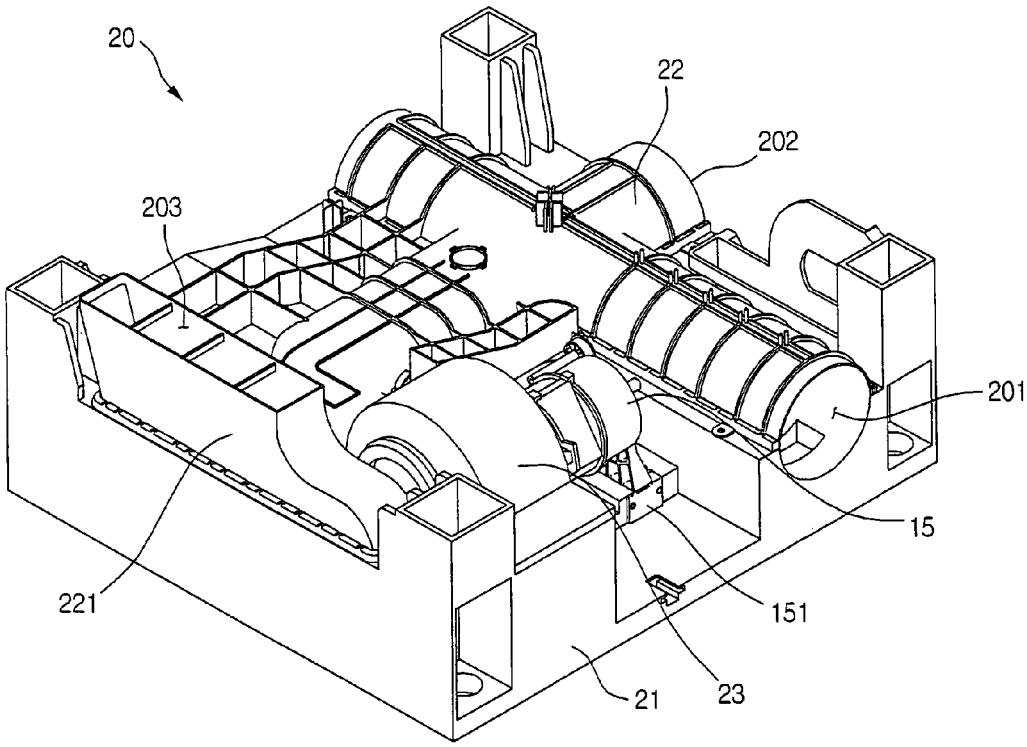
FIG. 2 is a perspective view of a base installed in a drying machine according to the present invention.

FIG. 2 is a perspective view of a base installed in a drying machine according to the present invention.

Referring to FIG. 2, the base 20 of the drying machine according to the present invention includes a base lower portion 21 and a base upper portion 22 mounted on top of the base lower portion 21.

In detail, the motor 15 is mounted on top of the base lower portion 21, and the passage for exhausting air is formed within the upper part of the base lower portion 21. The base upper portion 22 covers the air passage, so that the exhausting air is not dispelled but directed to flow in a predetermined direction.

In further detail, the base lower portion 21 and the base upper portion 22 are respectively plastic injection molded and coupled together in one piece by means of fasteners. However, the manufacturing method of the base 20 is not limited thereto, and may include being formed in a single piece. A drum connecting passage 203 is formed at the front upper portion of the base 20, and a side exhaust port 201 is formed at the side and a rear exhaust port 202 is formed at the rear of the base 20. The motor 15 is mounted to one side on top of the base 20, and a blower is connected to the rotating motor shaft to suction air from inside the drum. The blower 18 is protected by a blower cover 23. Here, the blower is installed at the front of the motor 15, as shown in FIG. 1. Moreover, a suctioning blower (installed at the rear of the base 20 and not depicted in FIG. 2) is attached to and operates by means of a separate motor.

In the above-described structure, the hot, moist discharged from the front of the drum 14 enters the drum connecting passage 203 and is exhausted back to the outside through the side exhaust port 201 and/or the rear exhaust port 202. Below, a detailed description of the air passages formed within the base 20 will be given, with reference to the diagrams.

Figure 3:
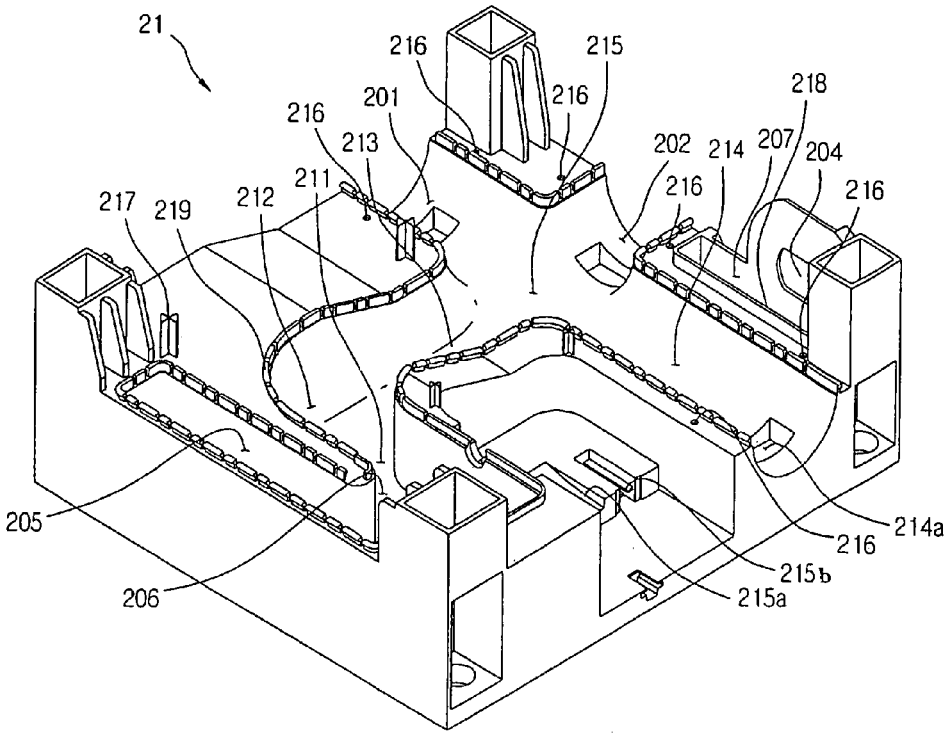
FIG. 3 is a perspective view of a base lower unit according to the present invention.

FIG. 3 is a perspective view of a base lower portion according to the present invention.

Referring to FIG. 3, the base 20 according to the present invention, as described above, includes a base lower portion 21 and a base upper portion 22 mounted on top of the base lower portion 21.

In detail, an air passage, through which air is exhausted from the drum 14, is formed in the base lower portion 21. A complete air passage is formed by covering the bottom half of the air passage with the base upper portion 22.

In more detail, a drum air descending passage 205, for the air passing from the drum 14 to descend, is formed at the front of the base lower portion 21. A blower entrance 206 is formed on one side of the drum air descending passage 205 for the descending air to be suctioned toward the blower. A blower compartment 211 is formed for mounting the blower at the blower entrance 206. An expanded passage portion 212 that bends at a predetermined angle and expands in diameter is connected to an end of the blower compartment 211. A main passage 213 that extends to the rear end of the base lower unit 21 is connected at the end of the expanded passage portion 212.

A sub passage 214 is formed to intersect with the main passage 213, forming the side exhaust ports 201 at either side of the base lower portion 21. A condensation pan **214*a* is respectively formed a predetermined depth into the floors at the rear exhaust port 202 and side exhaust ports 201, to collect condensing moisture from the exhausting air. A passage intersection 215 of the main passage 213 and the sub passage 214 is biased toward the rear of the base lower portion 21 from its center. That is, the sub passage 214 is closer to the rear of the base lower portion 21** than its front.

At least one base upper portion guiding protrusion 217 is formed on the top surface of the base lower portion 21, in order to guide the mounting position of the base upper portion 22 over the base lower portion 21. A fastening hook 219 is formed to protrude a predetermined height from along the perimeters of the main and sub passages 213 and 214, in order to tightly couple the base upper portion 22 to the base lower portion 21. Also, a plurality of fastening holes 216 are formed in the upper surface of the base lower portion 21, so that a fastening member (for fastening the base upper portion 22) can insert through the fastening hole 216. Specifically, the fastening holes 216 are formed symmetrically at the edges on either sides of the sub and main passages 214 and 213.

An outside air intake port 204 is formed at the rear of the base lower portion 21, to allow outside air to pass through the drying duct 17 into the drying drum. A suctioning blower is installed outside of the outside air intake port 204 in order to suction outside air. Here, the outside air suctioned through the outside air intake port 204 is air within the cabinet 11 of the drying machine 10. A lint entry preventing slot 207 recessed at a predetermined depth is formed at the front of the outside air intake port 204 for trapping lint and other impurities contained in outside air suctioned through the outside air intake port 204.

In more detail, a small amount of the water vapor that may leak through small gaps between the coupling portions of the base upper portion 22 and the base lower portion 21 may mix with the outside air suctioned through the outside air intake port 204. Also, lint particles may be contained in the air from the drum 14 that passes through the passages. Despite this, the impurities contained within the outside air suctioned through the outside air intake port 204 will be caught in the lint entry preventing slot 207, thereby reducing the amount of impurities that enters the drying duct 17.

A lint entry preventing ledge 218 is formed to protrude a predetermined height from around the perimeter of the lint entry preventing slot 207. That is, by forming the lint entry preventing ledge 218, impurities that leak through gaps between the coupling regions of the base upper portion 22 and the base lower portion 21 are blocked in a first stage. The air filtered in a first stage by the lint entry preventing ledge 218 is filtered once more in the lint entry preventing slot 207.

A motor mount 215*a* for mounting the motor 15 is formed in the space between the blower compartment 211 and the sub passage 214, where a motor supporting insert slot 215*b* is formed for supporting a motor supporter (not shown).

In the above structure, the water vapor that descends through the drum air descending passage 205 flows through the blower entrance 206 into the blower compartment 211. The air that enters the blower compartment 211 flows through the expanded passage portion 212 to the main passage 213. The air that flows to the main passage 213 branches at the passage intersection 215 and flows through at least one of the side exhaust ports 201 and/or the rear exhaust port 202 to the outside.

Here, a portion of the two side exhaust ports 201 and the rear exhaust port 202 may be sealed with caps. For example, if the drying machine 10 is installed in a corner, one of the side exhaust ports 201 and the rear exhaust port 202 may sealed with caps, with only the remaining side exhaust port 201 opened. That is to say that caps can be used to selectively seal the exhaust ports, as mandated by the installed location of the drying machine 10.

The air that flows toward the sealed exhaust ports during the circulation through the passages condenses, and the condensed water accumulates in the condensation pans 214*a*. Also, even when all the exhaust ports 201 and 202 are open, air that flows through the passages condenses, whereupon the condensed water accumulates in the condensation pans 214*a*.

Figure 4:
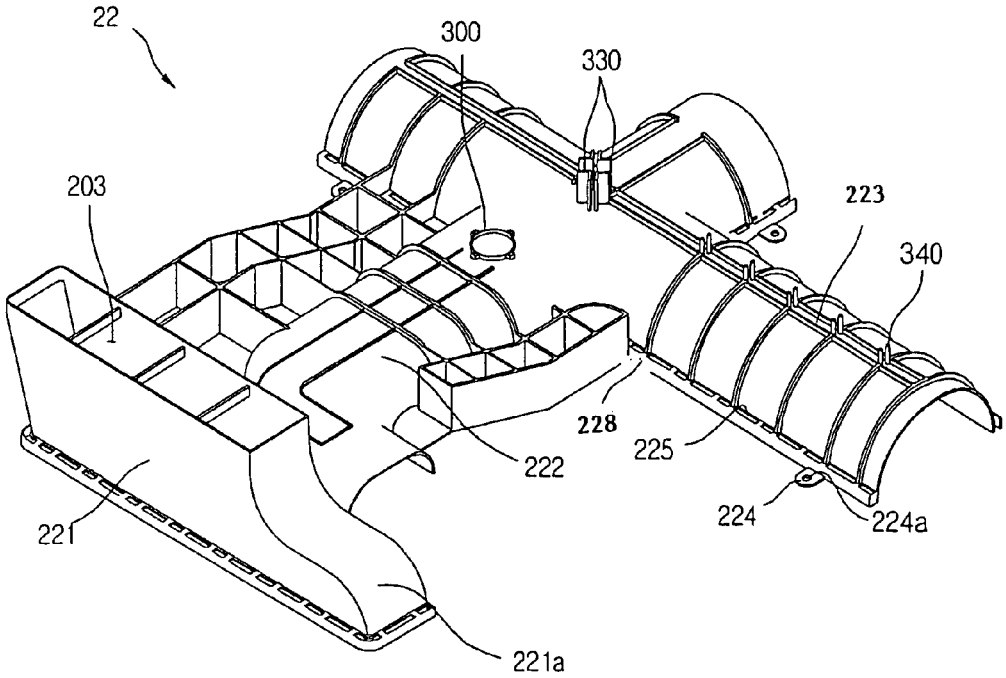
FIG. 4 is a perspective view of a base upper unit according to the present invention.
Figure 5:
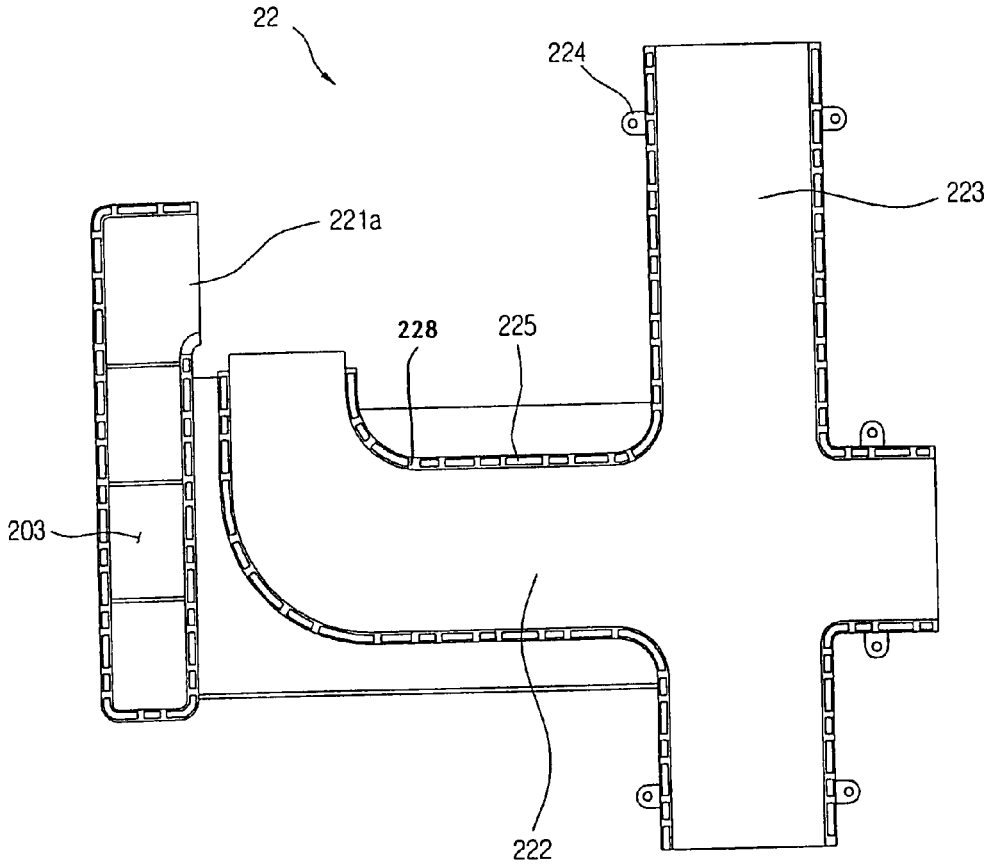
FIG. 5 is a plan view of the bottom of the base upper unit in FIG. 4.

FIG. 4 is a perspective view of a base upper portion according to the present invention, and FIG. 5 is a plan view of the bottom of the base upper portion in FIG. 4.

Referring to FIGS. 4 and 5, the base upper portion 22 according to the present invention, as described above, is mounted on top of the base lower portion 21.

Specifically, the base upper portion 22 is formed in a shape corresponding to that of the base lower portion 21 in terms of the passages, in order to seal the upper portion of the passages. A drum connecting passage 203 is formed at the front of the base upper portion 22, to provide an entrance for water vapor air exiting the drum 14 toward the passages.

In more detail, the drum connecting passage 203 extends a predetermined distance upward from the top of the base upper portion 22 to form the interior of a drum connecting duct 221. A blower connecting portion 221*a* is formed to extend from the side of the drum connecting duct 221, so that air passes through the drum connecting passage 203 and flows into the blower entrance 206 formed in the base lower portion 21.

A main passage cover 222 and a sub passage cover 223 are formed on the base upper portion 22 to cover the expanded passage portion 212, the main passage 213, and the sub passage 214 formed in the base lower portion 21. The main passage cover 222 and the sub passage cover 223 also intersect with each other. A humidity sensor mount 300 is formed in a portion of the main passage cover 222 for installing a humidity sensor therein, in order to detect the level of humidity of air flowing through the main passage 213.

A fringe 228 is formed to protrude a predetermined distance from the lower portions of the main passage cover 222 and the sub passage cover 223, and hook insert holes 225 in the fringe 228. Also, fastening hooks 219 are formed a predetermined distance apart from one another on the upper perimeters of the main passage 213 and the sub passage 214 of the base lower portion 21. The fastening hooks 219 insert into the hook insert holes 225.

The fastening tab 224 is formed to protrude further from the fringe 228 to fasten the base upper portion 22 to the base lower portion 21 more firmly. Specifically, a fastening hole 224*a* is formed in each fastening tab 224, so that a fastening member inserted through the fastening hole 224*a* inserts into the fastening hole 216 formed in the base lower portion 21. That is, the fastening member tightens the coupling of the base upper portion 22 to the base lower portion 21, so that no gaps are formed between the base upper and lower portions 22 and 21. In this way, the size of gaps formed between the base upper and lower portions 22 and 21 may be minimized, preventing leakage of air flowing within the passages and the possibility of it re-entering through the outside air intake port 204. In other words, the air flowing through the inside of the passages is prevented from leaking into the interior space of the cabinet 11 holding the drum 14 and being suctioned into the outside air intake port 204.

In the above structure, the water vapor that exits the drum 14 passes through the drum connecting passage 203 and descends to the drum air descending passage 205. The air that descends to the drum air descending passage 205 flows to the blower entrance 206. The air that descends to the drum connecting passage 203 flows along the blower connecting portion 221*a* and into the blower entrance 206. The air that enters the blower entrance 206 moves through the expanded passage portion 212, the main passage 213, and the sub passages 214. The air that flows through the main and sub passages 213 and 214 condenses and is exhausted to the outside through the rear exhaust port 202 and/or the side exhaust port(s) 201.

Figure 6:
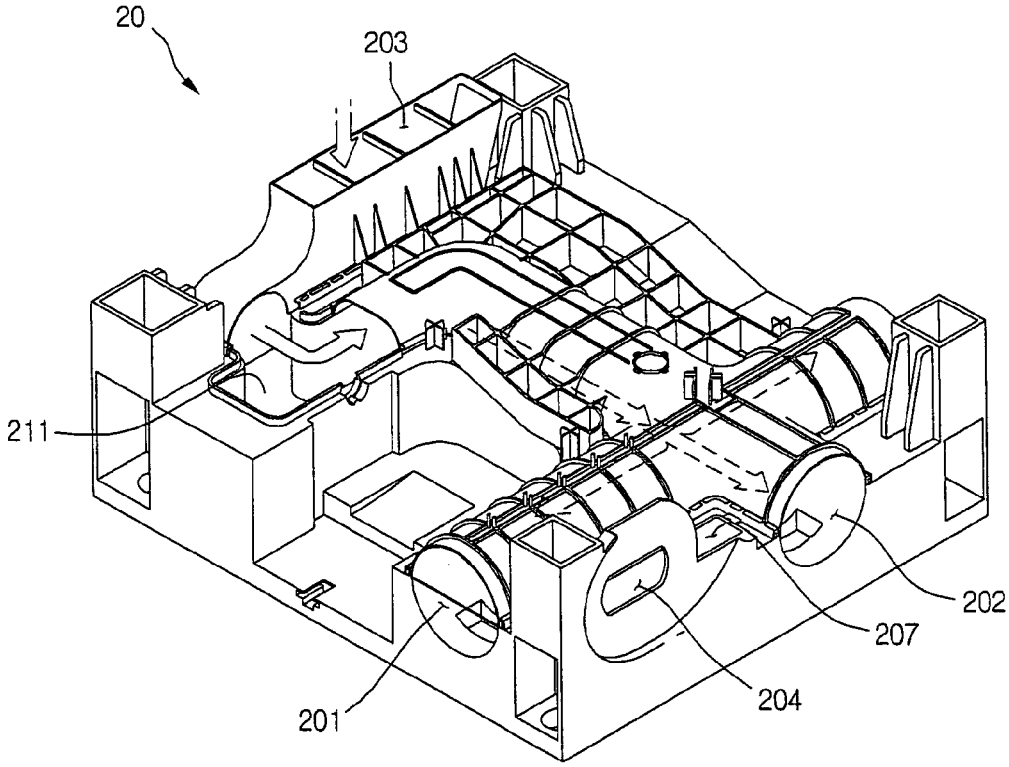
FIG. 6 is a perspective view showing airflow within a base according to the present invention.

FIG. 6 is a perspective view showing airflow within a base according to the present invention.

Referring to FIG. 6, as described above, the air that passes through the drum 14 passes through the lint filter installed in the front cover 111 to shed impurities in a first stage, and then descends through the drum connecting passage 203. Then, the air that descends through the drum connecting passage 203 moves to the blower entrance 206 formed at the end of the blower connecting portion 221*a*.

The air that moves to the blower entrance 206 is redirected by the blower installed in the blower compartment 211. The air that is redirected by the blower flows to the expanded passage portion 212. The flow direction of the air is redirected again at the expanded passage portion 212 to the main passage 213, and the air flows to the rear of the base 20. A portion of the air flowing through the main passage 213 branches off at the passage intersection 215 (where the main and sub passages 213 and 214 intersect) to the sub passages 214. The air flowing through the main and sub passages 213 and 214 flow through the rear exhaust port 202 and/or side exhaust port(s) 201 to be exhausted back to the outside. Here, the water vapor that exits the drum 14 cools (and a portion of the moisture in the air condenses) during the time it takes to flow from the drum connecting passage 203 to the exhaust ports 201 and 202. The condensed moisture accumulates in the condensation pans 214*a* recessed in the floors of the main and sub passages 213 and 214.

The outside air that flows into the rear of drum 14, that is, outside air with the same temperature and humidity of inside air, re-enters the drum 14 through the drying duct 17 through the outside air intake port 204 formed at the rear of the base 20.

Figure 7:
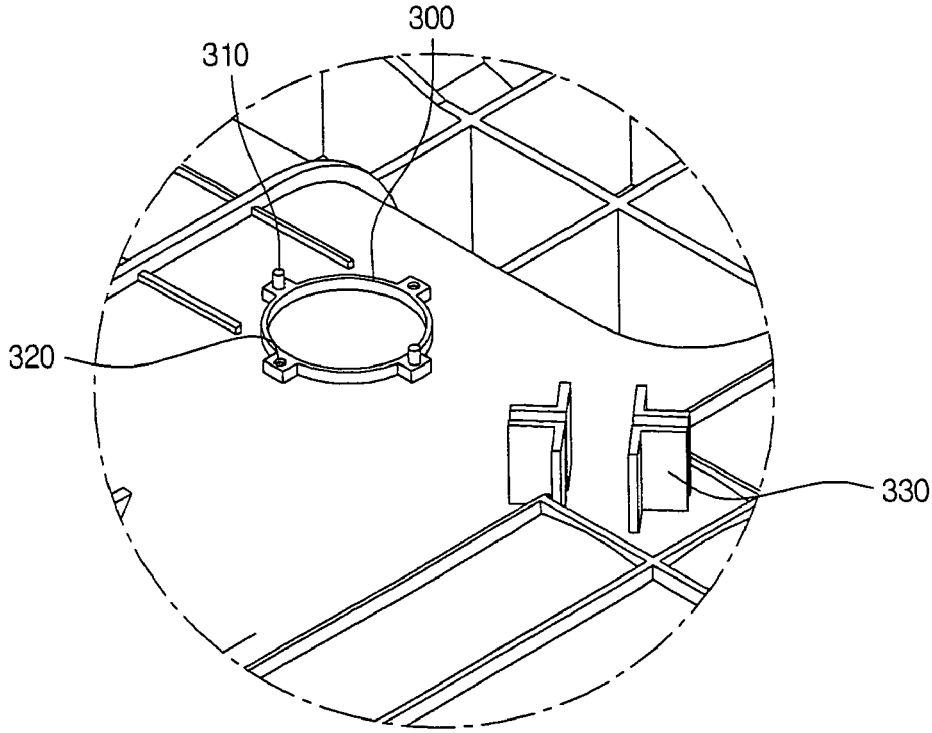
FIG. 7 is an enlarged perspective view showing a mounting portion for a moisture sensor formed on a base upper unit according to an embodiment of the present invention.
Figure 8:
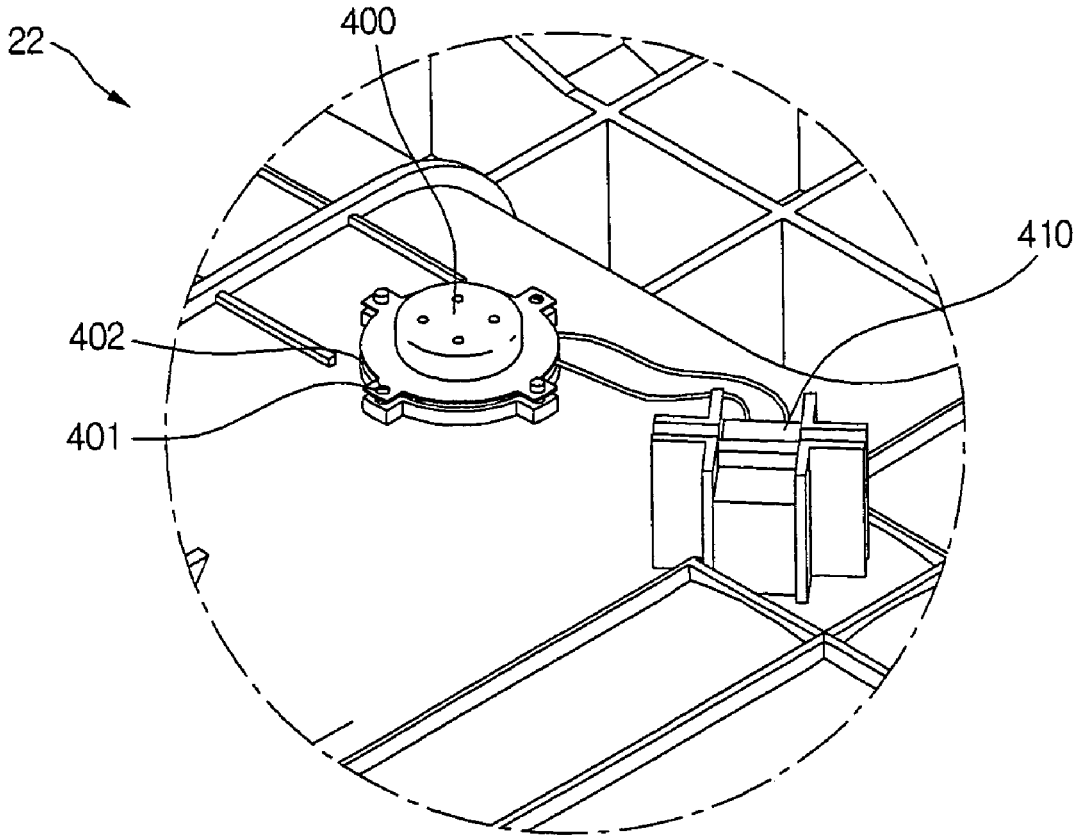
FIG. 8 is an enlarged perspective view showing an installed moisture sensor according to an embodiment of the present invention.

FIG. 7 is an enlarged perspective view showing a mounting portion for a moisture sensor formed on a base upper unit according to an embodiment of the present invention, and FIG. 8 is an enlarged perspective view showing an installed moisture sensor according to an embodiment of the present invention.

Referring to FIGS. 7 and 8, fastening holes 320 are formed a predetermined distance apart on an outer or inner perimeter of a moisture sensor mounting portion 300, in order to fasten a moisture sensor 400 on the upper surface of the base upper unit 22 by inserting predetermined fastening members in the fastening holes 320.

A fastening protrusion 310, for guiding the moisture sensor 400 to align a fastening holes 402 formed on the moisture sensor 400 with the fastening holes 320 formed on the outer perimeter of the moisture sensor mounting portion 300 during the process of coupling the moisture sensor 400 to the base upper unit 22, is formed on the outer perimeter of the moisture sensor mounting portion 300.

A fastening tab 401, having the fastening hole 402 formed therethrough, is formed to extend a predetermined length from the outer perimeter of the moisture sensor 400.

A connector 410 is connected to ends of cables for receiving moisture level values sensed by the moisture sensor 400 in the form of electrical signals.

In further detail, the connector 410 is a means for connecting cables extending from the micom (microcomputer) of the drying machine to the cables extending to the moisture sensor 400. Therefore, when the moisture sensor 400 needs to be serviced or replaced, only the cables connected at the connector 410 need to be disassembled.

Also, in order to prevent the moisture sensor 400 and the connector 410 from being shaken during transporting of the drying machine 10, the moisture sensor 400 and the connector 410 are respectively fixed by the moisture sensor mounting portion 300 and a connector supporting brace 330.

In further detail, in order to install the moisture sensor 400 on the base upper unit 22, fastening protrusions 310 formed on the outer perimeter of the moisture sensor mounting portion 300 insert into a portion of the fastening holes 402.

Screws or other fastening members are inserted through the remaining fastening holes 402 that do not have the fastening protrusions 310 inserted therein, to insert in the fastening holes 320 formed on the outer perimeter of the moisture sensor mounting portion 300.

Additionally, the connector 410 is mounted within the connector supporting brace 330, so that the connector 410 is unaffected by vibrations or shaking generated by the drying machine 10.

Because the connector 410 is a connecting member for cable-to-cable connecting, it is essential that the connector supporting brace 330 be impervious to juddering caused by external vibrations. The cables connecting the connector 410 with the micom are mounted between the two parts of the connector supporting brace 330 and extend along the upper surface of the sub passage cover 223 of the base upper unit 22.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A drying machine, comprising:

a cabinet; and a drum provided in the cabinet, wherein the drum is in air flow communication with a base, wherein the base comprises:

a base lower unit;

a base upper unit having a bottom surface thereof coupled to a top surface of the base lower unit, wherein the base upper unit and the base lower unit form a passage therebetween;

a moisture sensor mounting portion provided at a top portion of the base upper unit; and a moisture sensor mounted on the moisture sensor mounting portion, wherein the moisture sensor senses a moisture level of air flowing through the passage.

2. The drying machine according to claim 1, wherein the moisture sensor mounting portion is a hole with a predetermined diameter.

3. The drying machine according to claim 1, wherein the moisture sensor is mounted on the moisture sensor mounting portion through press-fitting.

4. The drying machine according to claim 1, wherein a predetermined portion of the moisture sensor mounting portion on which the moisture sensor is mounted is a material with a predetermined elasticity.

5. The drying machine according to claim 1, wherein the moisture sensor mounting portion includes at least one fastening protrusion that extends from an outer perimeter of the mounting portion, wherein the at least one protrusion engages a corresponding portion of the moisture sensor so as to guide a mounting of the moisture sensor on the mounting portion.

6. The drying machine according to claim 1, wherein the base upper unit includes at least one fastening recess provided a predetermined distance from an inner perimeter of the moisture sensor mounting portion, wherein the moisture sensor is coupled to the top portion of the base upper unit through the at least one fastening recess.

7. The drying machine according to claim 1, wherein the moisture sensor includes at least one fastening tab that extends outward from an outer perimeter of the moisture sensor, wherein a fastening hole is formed in the at least one fastening tab.

8. The drying machine according to claim 7, wherein the base upper unit includes at least one fastening recess corresponding to the at least one fastening tab, wherein a fastening member passes through the fastening hole and into the fastening recess to couple the moisture sensor to the base upper unit.

9. The drying machine according to claim 1, wherein the base upper unit further comprises a supporting brace provided on an upper surface thereof, wherein the supporting brace receives a connector that connects at least one cable to the moisture sensor.

10. The drying machine according to claim 9, wherein the connector connects at least one cable that extends from a microcomputer of the drying machine to the at least one cable connected to the moisture sensor.

11. The drying machine according to claim 1, further comprising a supporting brace that guides a cable extending thereto from the moisture sensor.

12. A drying machine for drying laundry, the drying machine having a drum for receiving laundry, the drying machine comprising:

a base coupled to and in air flow communication with the drum, wherein the base is provided external to the drum so as to form an external passage for water vapor exiting the drum;

a moisture sensor provided on a side of the external passage formed outside of the drum, wherein the moisture sensor senses a moisture level of the water vapor passing through the external passage; and a microcomputer that receives the sensed moisture level from the moisture sensor and controls a drying cycle of the drying machine based on the sensed moisture level.

13. The drying machine according to claim 12, wherein the base includes a base lower unit and a base upper unit coupled to an upper portion of the base lower unit, wherein the moisture sensor is coupled to an upper surface of the base upper unit.

14. The drying machine according to claim 13, wherein the moisture sensor includes at least one fastening tab extending outward from an outer perimeter thereof, wherein a fastening hole is formed in the at least one fastening tab, and wherein the moisture sensor is coupled to the base upper unit by a fastening member that extends through the fastening hole formed in the at least one fastening tab.

15. The drying machine according to claim 12, further comprising a connector provided at an upper surface of the base, wherein the connector connects a cable connected to the moisture sensor to a cable connected to the microcomputer.

16. A drying machine, comprising:

a drum rotatably installed in a cabinet;

a base coupled to a bottom of the cabinet, wherein the base forms an external passage that receives air from the drum, the external passage including a main passage and a sub passage; and a moisture sensor that extends through an upper surface of the main passage or the sub passage, wherein the moisture sensor senses a moisture level of air passing through the external passage.

17. The drying machine according to claim 16, further comprising a moisture sensor mounting portion formed as a hole in an upper portion of the main or sub passage, wherein the moisture sensor is inserted into and coupled to the moisture sensor mounting portion.

18. The drying machine according to claim 16, further comprising at least one fastening hole formed at an outer perimeter of the moisture sensor and at least one corresponding fastening recess formed in a surface of the base above the main or sub passage, wherein a fastening member is inserted through the fastening hole and into the fastening recess to mount the moisture sensor above the main or sub passage.

19. The drying machine according to claim 17, wherein a portion of the moisture sensor mounting portion that contacts the moisture sensor is made of a material having a predetermined elasticity.

20. The drying machine according to claim 1, wherein the moisture sensor mounting portion includes a plurality of tabs each extending outward from an outer circumferential surface of the mounting portion, wherein the plurality of tabs engage with corresponding portions of the moisture sensor so as to couple the moisture sensor to the base upper portion.

21. The drying machine according to claim 20, wherein the plurality of tabs comprises a first pair of tabs each having a recess formed therein, and a second pair of tabs each having a protrusion extending upward therefrom.

22. The drying machine according to claim 21, wherein the sensor comprises a third pair of tabs and a fourth pair of tabs respectively corresponding to the first and second pairs of tabs of the mounting portion, wherein the third and fourth pairs of tabs each have holes formed therethrough corresponding to the recesses and protrusions of the first and second pairs of tabs, respectively.

23. The drying machine according to claim 22, wherein the protrusions of the second pair of tabs extend through the holes in the third pair of tabs so as to align the moisture sensor with the mounting portion.

24. The drying machine according to claim 23, further comprising a pair of fasteners that extend through the holes in the fourth pair of tabs and into the recesses formed in the first pair of tabs so as to fasten the moisture sensor to the mounting portion of the base upper portion.

25. The drying machine according to claim 20, wherein the tabs of the first pair of tabs face each other on opposite sides of the mounting portion, and the tabs of the second pair of tabs face each other on opposite sides of the mounting portion.

26. The drying machine according to claim 14, wherein the fastening member extends through the fastening hole and into a corresponding recess formed in the base upper unit to couple the moisture sensor to the base.

27. The drying machine according to claim 1, wherein the base is coupled to a bottom of the cabinet such that the passage formed between the base upper and lower units is formed external to the drum.

28. The drying machine according to claim 2, wherein the moisture sensor extends through the moisture sensor mounting portion, through a top surface of the base upper unit, and into the passage.

* * * * *